US006540212B2

(12) United States Patent
Burns et al.

(10) Patent No.: US 6,540,212 B2
(45) Date of Patent: Apr. 1, 2003

(54) CARBURETOR VALVE ROTATIONAL SETTING RETAINER ASSEMBLY

(75) Inventors: Michael P. Burns, Millington, MI (US); Gary U. Gliniecki, Ruth, MI (US); George M. Pattullo, Caro, MI (US); James E. VanAllen, Clifford, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 10/060,446

(22) Filed: Feb. 1, 2002

(65) Prior Publication Data

US 2002/0070466 A1 Jun. 13, 2002

Related U.S. Application Data

(60) Division of application No. 09/798,602, filed on Mar. 2, 2001, now Pat. No. 6,402,125, which is a continuation-in-part of application No. 09/538,123, filed on Mar. 29, 2000, now Pat. No. 6,402,124.

(51) Int. Cl.[7] ..... F02M 3/08

(52) U.S. Cl. ..... 261/71; 137/382; 251/227; 261/DIG. 38; 261/DIG. 84

(58) Field of Search ..... 261/71, DIG. 38, 261/DIG. 84, DIG. 39; 137/382; 251/227

(56) References Cited

U.S. PATENT DOCUMENTS

| | | | | | |
|---|---|---|---|---|---|
| 3,425,672 | A | * | 2/1969 | Seigel et al. | 261/DIG. 38 |
| 3,469,825 | A | * | 9/1969 | DuBois | 261/71 |
| 4,097,561 | A | * | 6/1978 | Seki et al. | 261/DIG. 38 |
| 4,271,093 | A | * | 6/1981 | Kobayashi | 261/DIG. 68 |
| 4,283,353 | A | * | 8/1981 | Miller | 261/71 X |
| 4,336,208 | A | * | 6/1982 | Gerhardy | 261/DIG. 38 |
| 4,568,499 | A | * | 2/1986 | Wood | 261/DIG. 38 |
| 4,759,883 | A | * | 7/1988 | Woody et al. | 261/DIG. 84 |
| 5,133,905 | A | * | 7/1992 | Woody et al. | 261/35 |
| 5,236,634 | A | * | 8/1993 | Hammett et al. | 261/DIG. 84 |
| 5,262,092 | A | * | 11/1993 | Reeder et al. | 261/35 |
| 5,525,267 | A | * | 6/1996 | Araki | 261/DIG. 84 |
| 5,635,113 | A | * | 6/1997 | Walsh et al. | 261/DIG. 38 |
| 5,695,693 | A | | 12/1997 | Koizumi et al. | 261/71 |
| 5,707,561 | A | | 1/1998 | Swanson | 261/71 |
| 5,753,148 | A | | 5/1998 | King et al. | 261/71 |
| 5,772,927 | A | | 6/1998 | Koizumi et al. | 261/DIG. 38 |
| 5,776,379 | A | | 7/1998 | Bowles | 261/DIG. 38 |
| 5,961,896 | A | | 10/1999 | Koizumi et al. | 261/71 X |
| 5,984,281 | A | | 11/1999 | Hacker et al. | 261/71 |
| 6,003,845 | A | | 12/1999 | Kus | 261/71 X |
| 6,302,384 | B1 | | 10/2001 | Douyama | 261/71 |
| 6,402,124 | B1 | * | 6/2002 | Pattullo et al. | 261/71 |
| 6,402,125 | B1 | * | 6/2002 | Burns et al. | 261/71 |

FOREIGN PATENT DOCUMENTS

JP 9-158783 * 6/1997

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A fuel needle valve assembly of a carburetor has a retainer which yieldingly restrains the rotational fuel flow setting capability of the needle valve. The retainer engages a shank of the needle valve and a parallel shaft, both of which project from the carburetor body. The retainer exerts a force which laterally displaces the projecting shank with respect to the shaft. The retainer has sufficient strength to ensure the factory set rotational setting of the fuel needle valve does not alter when a limiter cap is press fitted to a distal head of the needle. Furthermore, wherein the shaft is also a shank of a second needle valve, the same retainer laterally displaces the projecting shanks of both needle valves.

19 Claims, 4 Drawing Sheets

CARBURETOR VALVE ROTATIONAL SETTING RETAINER ASSEMBLY

REFERENCE TO COPENDING APPLICATION

This application is a division of application Ser. No. 09/798,602, filed Mar. 2, 2001, now U.S. Pat. No. 6,402,125, which in turn is a continuation-in-part of application Ser. No. 09/538,123, filed Mar. 29, 2000, now U.S. Pat. No. 6,402,124.

FIELD OF THE INVENTION

This invention relates to a carburetor valve rotational setting retainer assembly, and more particularly to a rotational setting retainer assembly for low and high-speed needle valves of a carburetor for a combustion engine.

BACKGROUND OF THE INVENTION

Government agencies of an increasing number of countries are imposing exhaust emission control regulations to protect the environment. These regulations are being applied to all combustion engines including portable or two cycle engines used in common equipment such as chain saws, lawn mowers and hedge trimmers. One means of limiting excessive exhaust emissions in a small engine is to restrict the maximum amount of fuel delivered to the combustion chamber. This maximum fuel amount is preset on each individual engine by the engine manufacturer with the understanding that the end user requires some adjustment capability to meet changing work conditions and environmental factors such as altitude. The higher the altitude, the lower the air density, and the lower the fuel amount necessary to operate the engine. The user of the engine must therefore be able to adjust the fuel to air mixture ratios and may do so via low and high-speed needle valves protruding from the carburetor.

Not only is it desirable to limit the richness of the fuel to air mixture because of exhaust emission regulatory concerns, but the engine manufacturer of a portable combustion engine product also wants to restrict minimum amounts of fuel, or the leanness of the fuel to air mixture. Often a user will desire more power from a small engine and will attempt to operate the engine in an ultra-lean state. This will deprive an engine of proper cooling and will lead to warranty concerns. Therefore, limiter caps are designed not only to restrict the carburetor to a maximum amount of fuel, but also to restrict the carburetor to a minimum amount of fuel.

Not only is it desirable to limit the maximum and minimum amounts of fuel, but it is also desirable to hold steady the fuel flow in a running engine. Any rotation of the needle of the needle valve, possibly caused by the vibration of a running engine would alter the fuel flow. Therefore, it is desirable to restrain the rotation of the needle of the needle valves thereby preventing any unintended changes to the fuel flow setting. Traditionally, compressed springs are disposed concentrically about the needle and axially between the carburetor body and the head of the needle valve. The spring induced axial force produces increased frictional forces amongst the threads between the carburetor body and the needle, thus resisting needle rotation and alteration of the fuel flow setting.

Unfortunately, engine vibration is not the only source of unintentionally altered fuel flow. Lateral wobble and axial shifting of the needle tip, disposed within an orifice of the carburetor fuel feed channel, can cause fuel flow changes resulting in a rough running engine. Furthermore, the factory prescribed setting of the low and high-speed needle valves can be rotatably and axially altered when the limit caps are applied to the heads of each needle. For further background information on needle tip wobble, see U.S. patent application Ser. No. 09/584,970 filed on Jun. 1, 2000 which is incorporated by reference herein.

SUMMARY OF THE INVENTION

A retaining assembly maintains the factory pre-set fuel flow settings during the later attachment of a limiter cap to a fuel needle valve of a carburetor. A retainer disposed outward from the carburetor body laterally biases the fuel needle valve which increases frictional forces between the adjustment threads of the needle and carburetor body. The retainer also provides rotation resistant friction between the valve and the retainer itself. Preferably, the carburetor has a pair of spaced-apart and generally parallel low and high-speed needle valves. However, the carburetor may have a single fuel needle valve and a parallel rod cooperating with the retainer to inhibit rotation of the single valve.

Each valve has a needle which adjustably threads to the carburetor body. A shank of the needle protrudes from the carburetor body and engages concentrically a radially enlarged head at the distal end. Restraining rotation of the needle by exerting an axial force is a spring compressed concentrically between the head of the needle and the carburetor body. Restraining rotation of both needles by exerting a lateral force is a retainer aligned generally axially between the carburetor body and the heads of the needles, and preferably disposed radially outward from the springs of the low and high-speed needle valves.

Preferably, the needles have a needle tip which resides within a fuel flow orifice of the carburetor body. Both axial and lateral movement of the tip relative to the orifice respectively changes fuel flow into the throttling bore or mixture chamber. The retainer produces bending stresses and strains within the needles of both valves which propagate longitudinally down the needle to the tip. The tip is thereby biased laterally toward a side of the orifice.

Objects, features and advantages of this invention include the elimination of needle tip wobble which adversely effects fuel flow, providing a simple and inexpensive means to restrain rotation of the low and high speed needle valves, and facilitating and preserving final fuel flow adjustment of the carburetor.

BRIEF DESCRIPTION OF THE DRAWINGS

These and other objects, features and advantages of this invention will be apparent from the following detailed description of the preferred embodiments and best mode, appended claims and accompany drawings in which;

DETAILED DESCRIPTION OF THE PREFERRED EMBODIMENTS

Figure 1:
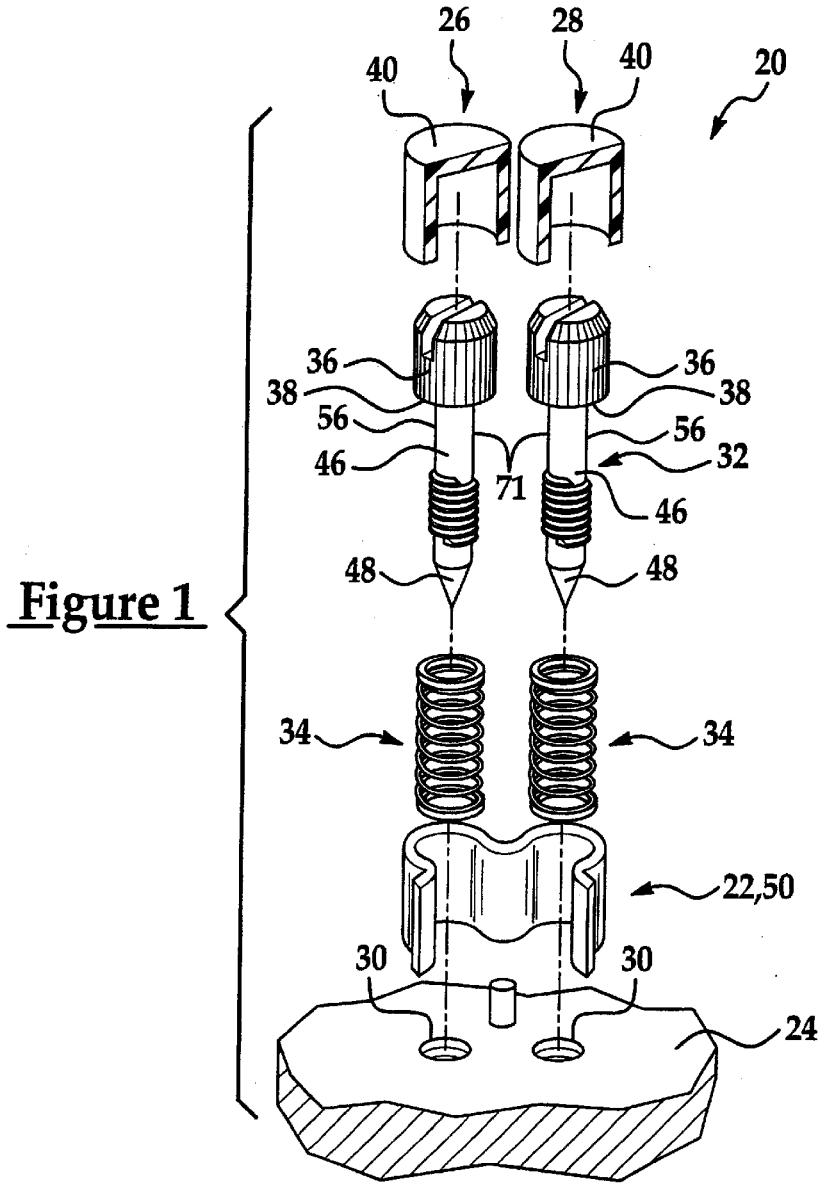
FIG. 1 is an exploded perspective view of a carburetor valve rotational setting retainer assembly having a low and high speed needle valve of this invention.

Referring in more detail to the drawings, FIGS. 1–4 show a low and high speed needle valve assembly 20 having a biasing retainer 22, embodying the present invention. Mounting threadably to a carburetor body 24 are low and high-speed needle valves 26, 28 which move longitudinally, via rotation, in and out of respective threaded ports 30 defined by the carburetor body 24. Air flowing through a throttling bore 31 extending through the carburetor body 24 mixes with a prescribed fuel quantity, or flow rate, controlled by the low and high speed needle valves 26, 28. The fuel flow rate within the carburetor body 24 is adjusted by threadably rotating the needle 32 within the respective port 30 either inward to reduce the fuel flow or outward from the carburetor body 24 to increase the fuel flow.

The low and high-speed needle valves 26, 28 each have a spring 34 and a shank or needle 32. The spring 34 provides resistance against unintentional rotation of the needle 32. The spring 34 concentrically encircles the needle 32 and is compressed axially between a radially extended head 36 of the needle 32 and the carburetor body 24, the spring 34 engaging an inward facing annular surface 38 defined by the radially expanded head 36. The axial constant force produced by the compression of the spring 34 provides the resistance which restrains rotation of the needle 32 by creating friction between the threads of the carburetor body 24 and the needle 32 within the port 30.

Customarily, the low and high-speed needle valves 26, 28 of each carburetor are adjusted and set at the factory by the engine manufacturer after the carburetor body 24 is mounted to a running combustion engine, not shown. If the fuel and air mixture is too lean, the running engine may over heat causing warranty concerns. If the fuel and air mixture is too rich, government regulatory emission requirements may be exceeded or violated. Therefore, limiting adjustment capability by the end user of the engine of the low and high-speed needle valves 26, 28 within an acceptable range is desirable. The engagement of known limiter caps 40 to the valves 26, 28 establishes the end user adjustment range for fuel flow within the carburetor (i.e. neither too rich nor too lean). The limiter caps 40 are press fitted over the heads 36 of the low and high-speed needle valves 26, 28 in the factory after the proper fuel flow settings are made.

Without the retainer assembly and after factory adjustment by the engine manufacturer, the press fitting of the limiter caps 40 to the heads 36 of either one or both of the needles 32 may unintentionally rotate, wobble or laterally shift the needles causing the factory setting and prescribed adjustment range of the needles 32 to be altered or changed. To feasibly solve this problem, the single retainer 22 of the present invention engages and laterally biases a shank 46 of each needle 32 which protrudes outward from the carburetor body 24. Preferably, the retainer 22 is axially aligned and disposed radially outward from the respective springs 34. The lateral force exerted by the retainer 22 against the springs 34 causes the springs 34 to exert a lateral force against the shanks 46 of the needles 32. The needles 32, therefore, are skewed against, or tend to favor one side, of the respective ports 30. The resultant friction between the springs 34 and the shanks 46 along with the increased friction between the threads of the needles 32 and ports 30 will assist the springs 34 to further resist any rotation of the needles 32. That is, the axial force produced by the springs 34 is compounded by the lateral force produced by the retainer 22. Furthermore, the necessity of utilizing the spring 34 to resist rotation can be eliminated with a sufficiently strong or appropriately sized retainer 22. In such an embodiment, the force produced by the retainer 22 is exerted directly on the shanks 46 of the low and high speed needle valves 26, 28.

Another feature of the retainer 22 is the elimination or reduction of needle tip 48 wobble within an orifice of the fuel flow channel of the carburetor body 24, not shown. The wobble action of the tip 48 of the needle 32 is caused by machining tolerance limitations of the carburetor body 24 threads contained within port 30 and the mating threads of needle 32. The resultant wobble can affect fuel flow causing a rough running combustion engine. The exertion of a lateral bias or force upon the shanks 46 of the needles 32 by the retainer 22 will produce a longitudinal stress and strain along the needle 32. This causes the needle 32 to favor or even bear on one side of the orifice and thereby eliminates some or all of the adverse wobble effects.

Figure 2:
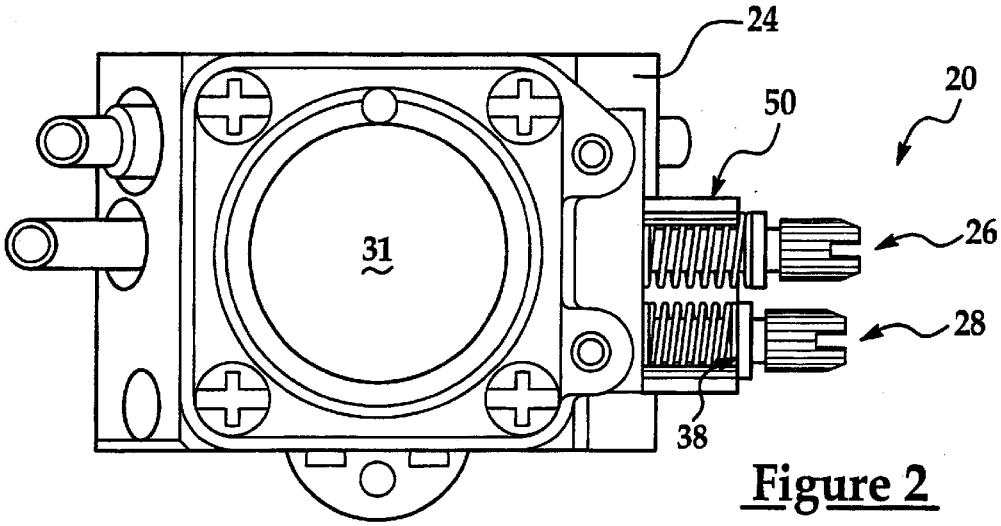
FIG. 2 is a bottom view of a carburetor illustrating the retainer assembly laterally biasing a low-speed needle and a high-speed needle valve toward each other.
Figure 3:
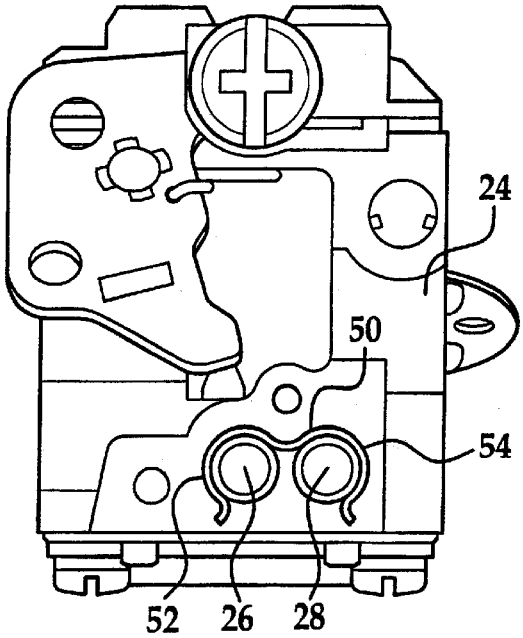
FIG. 3 is a side view of the carburetor.
Figure 4:
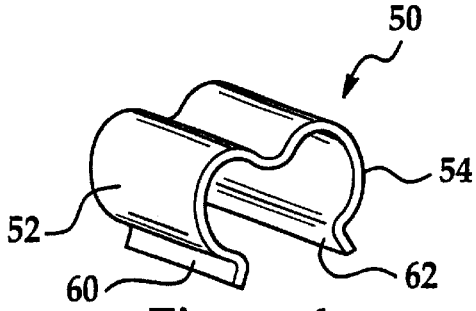
FIG. 4 is a perspective view of a first embodiment of the retainer being a clip retainer.

Referring to FIGS. 2–4, a first embodiment of the retainer 22 is illustrated as a clip retainer 50 which laterally engages both springs 34 of the respective low and high-speed needle valves 26, 28 to laterally bias the projecting portions of the shanks 46 toward one another. An angled first leg 52 of the clip retainer 50 engages the spring 34 and thereby interconnects with a longitudinal outward surface 56 of the shank 46 of the low speed needle valve 26, which faces outward with respect to the high-speed needle valve 28. An angled second leg 54 of the clip retainer 50 engages the other spring 34 and interconnects with a longitudinal outward face 56 of the shank 46 of the high-speed needle valve 28, which faces outward with respect to the shank 46 of the low-speed needle valve 26. The clip retainer 50 laterally snap fits or is interference fitted about both the low and high-speed needle valves 26, 28. To assist in the snap fit, the distal ends 60, 62 of the respective first and second legs 52, 54 bend substantially radially outward with respect to the shank 46 of the respective low and high-speed needle valves 26, 28.

Figure 5:
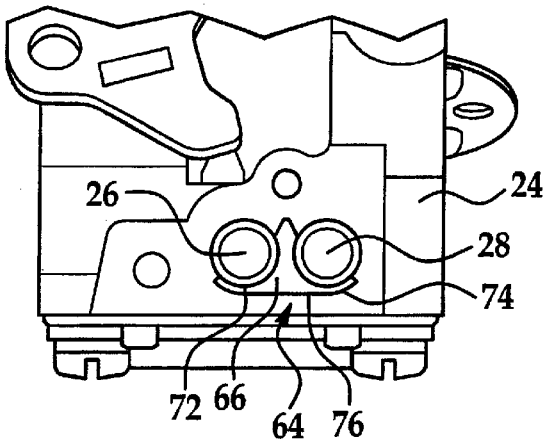
FIG. 5 is a side view of the carburetor illustrating a second embodiment of the retainer being a wedge retainer.
Figure 6:
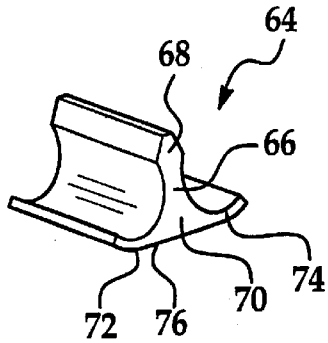
FIG. 6 is a perspective view of the wedge retainer.

Referring to FIGS. 1, 5 and 6, a second embodiment of the retainer 22 is shown as a wedge retainer 64. The wedge retainer 64 may take the form of a variety of shapes including an L-shape, an I-shape and preferably a T-shape. The wedge retainer 64 has a substantially planar primary member 66 which is wedged, via a snap fit, between and thereby engages the springs 34 of the low and high-speed needle valves 26, 28. The wedging effect causes the projecting portions of the shanks 46 to laterally bias outward from one another. Providing the snap fit is an enlarged distal end 68 of the primary member 66. The thickness of the distal end 68 is appreciably larger than the distance between the low and high speed needle valves 26, 28 in the assembled state. The primary member 66 also has an enlarged base end 70 ensuring, when coupled with the enlarged distal end 68, that the wedge retainer 64 has minimal lateral movement and remains wedged between the springs 34 or shanks 46 during end user adjustment rotation of the low or high-speed needle valves 26, 28. The primary member 66 with the enlarged distal and base ends 68, 70 form the I-shape referred to above.

The primary member 66 of the wedge retainer 64 engages the springs 34 on one side between the distal and base ends 68, 70 and thereby interconnects with a longitudinal inward face 71 of the shank 46 of the low-speed needle valve 26 which radially faces generally toward the shank 46 of the high-speed needle valve 28. Likewise, the primary member 66 engages the other spring 34 on the other side and thereby interconnects with the longitudinal inward surface 71 of the shank 46 of the high speed needle valve 28 which faces substantially toward the shank 46 of the low-speed needle valve 26.

The wedge retainer 64 has a substantially planar first base member 72 extending substantially perpendicularly from the primary member 66 along the base end 70. Base member 72 is disposed generally tangentially with respect to the shank 46 of the low-speed needle valve 26. The primary member 66 coupled with the first base member 72 form the L-shape referred to above. Preferably, the wedge retainer 64 also has a substantially planar second base member 74 extending from the primary member 66 along the base end 70, but in an opposite direction with respect to the first base member 72. The second base member 74 lies generally tangentially to the shank 46 of the high-speed needle valve 28. The first and second base members 72, 74 lie substantially within the same imaginary plane and thereby compose an enlarged surface 76 upon which a force can be exerted to snap fit the wedge retainer 64 between the low-and high-speed needle valves 26, 28. The primary, first base and second base members 64, 72, 74 form the T-shape referred to above.

Figure 7:
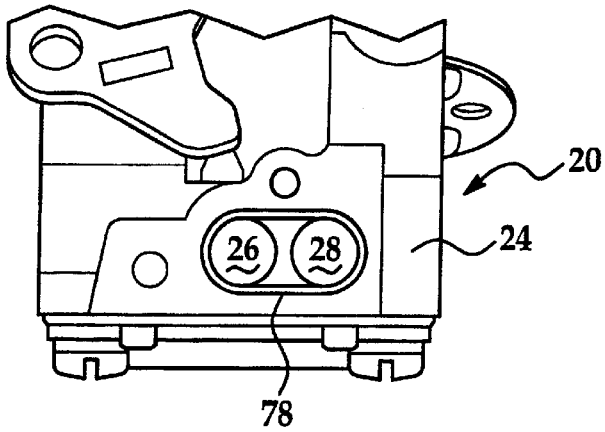
FIG. 7 is a partial side view of the carburetor illustrating a third embodiment of the retainer being a band retainer.
Figure 8:
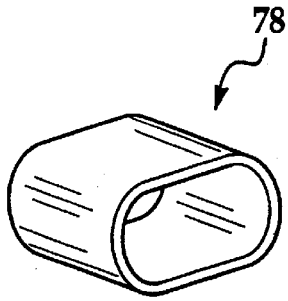
FIG. 8 is a perspective view of the band retainer.

Referring to FIGS. 1, 7 and 8, a third embodiment of the present invention is shown wherein the retainer 22 is a band retainer 78. Like the clip retainer 50, the band retainer 78 laterally bands or biases together the projecting portions of the shanks 46 of the respective low and high-speed needle valves 26, 28. The band retainer 78 encircles both the shanks 46 of the low and high-speed needle valves 26, 28 and may be made of an elastic or plastic material which may also have a shrinking capability upon the application of heat.

Figure 9:
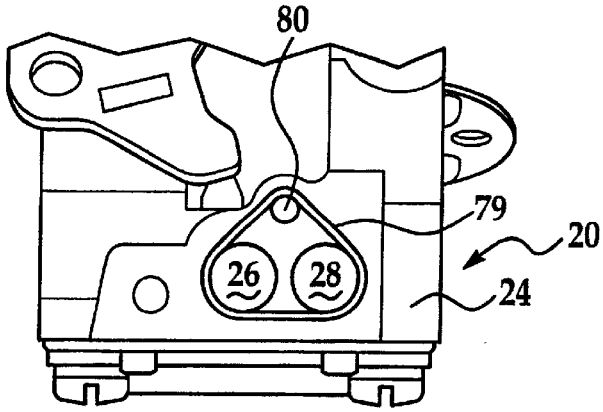
FIG. 9 is a partial side view of the carburetor illustrating a fourth embodiment of the retainer being a triangular band retainer having a pin.
Figure 10:
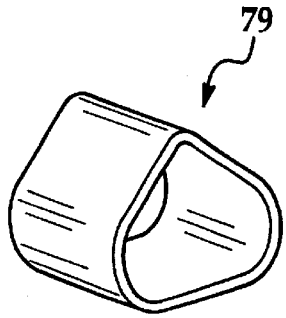
FIG. 10 is a perspective view of the triangular band retainer.

Referring to FIGS. 1, 9 and 10 a fourth embodiment of the retainer 22 is shown as being a triangular band retainer 79 having a slightly larger diameter or circumference than the band retainer 78. The larger diameter enables the band retainer 79 to encircle not only the shanks 46 but also a pin 80 which rigidly protrudes outward from the carburetor body 24. The pin 80 is preferably and substantially disposed at an equal distance from the low and high-speed needle valves 26, 28. As with band retainer 78 above, the triangular band retainer 79 can be made of the same material as the band retainer 78.

Figure 11:
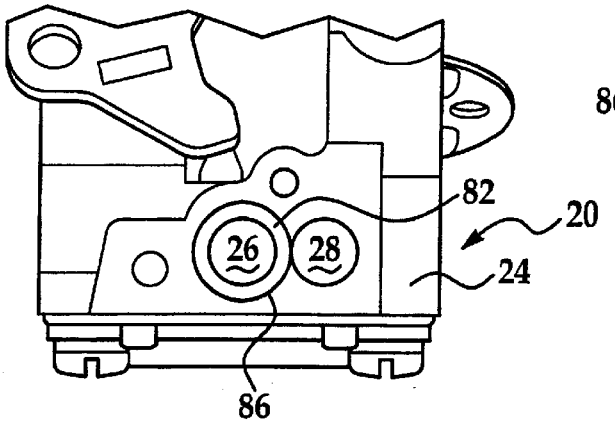
FIG. 11 is a partial side view of the carburetor illustrating a fifth embodiment of the retainer being a ring retainer.
Figure 12:
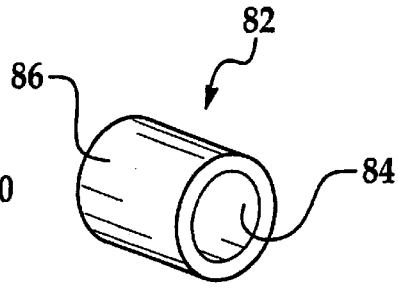
FIG. 12 is a perspective view of the ring retainer.
Figure 13:
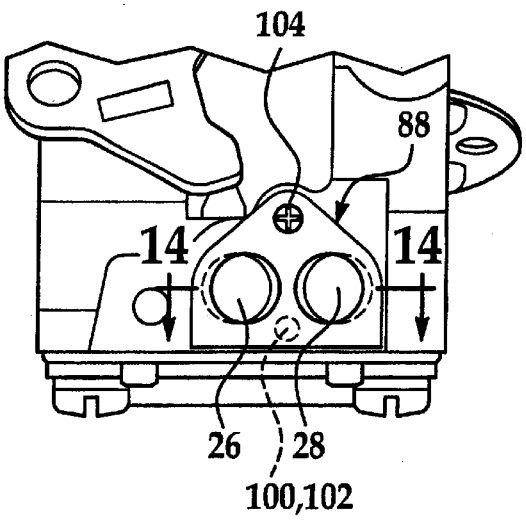
FIG. 13 is a partial side view of the carburetor illustrating a sixth embodiment of the retainer being a block retainer.

Referring to FIGS. 1, 11 and 12, a fifth embodiment of the retainer 22 is shown as being a ring retainer 82 preferably made of a plastic material. The ring retainer 82 biases the projecting portions of the shanks 46 of the low and high-speed needle valves 26, 28 similar to the wedge retainer 64. The ring retainer 82 is concentrically disposed about the spring 34 and the shank 46 of either the low or high-speed needle valves 26, 28. The thickness of the ring retainer 82 wall is slightly larger than the distance between the needle valves 26, 28 and is defined by a circumferential inward surface 84 and a circumferential outward surface 86. Because the radial distance between the inward surface 84 and the outward surface 86 is larger than the distance between the springs 34, the ring retainer 82 laterally biases the projecting portions of the shanks 46 outward or away from one another.

Referring to FIGS. 1, 13–15, a sixth embodiment of the retainer 22 is shown as being a block retainer 88. The block retainer 88 laterally displaces either one of the shanks 46 of the low and high-speed needle valves 26, 28. The block retainer 88 has a continuous curved surface 90 defining an angled bore 91 and extended between an inward perimeter 92 and an outward perimeter 94. The inward perimeter 92 is centered about a centerline 96 of the respective hole 30. The outward perimeter 94 is radially mis-aligned to the centerline 96 of the hole 30. This mis-alignment forces the low or high-speed needle valves 26, 28 to become laterally displaced. The non-displaced needle valve inserts within a pilot hole 98 (shown in FIG. 15) of the block retainer 88 which is centered about the centerline 96 of the other hole 30.

Figure 14:
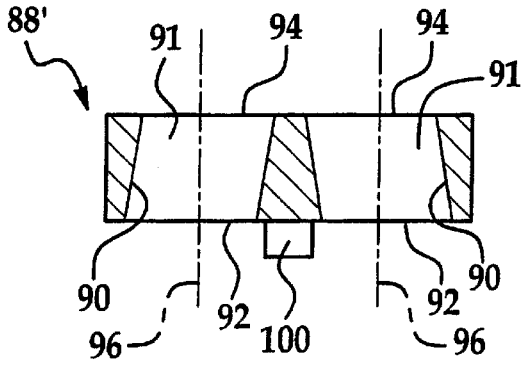
FIG. 14 is a cross section view of the block retainer having two angled bores taken along line 14—14 of FIG. 13.
Figure 15:
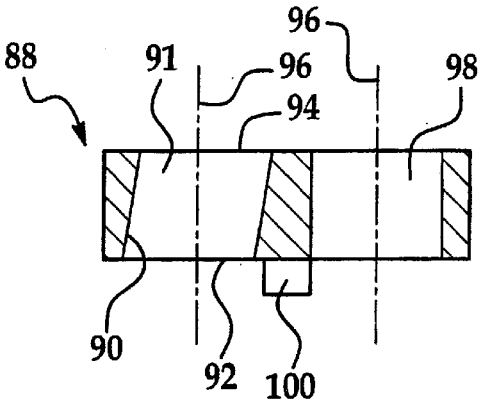
FIG. 15 is the cross section view of the block retainer of FIG. 14 with one of the angled bores replaced with a pilot hole.

Referring to FIG. 14, block retainer 88' is shown wherein lateral displacement of both the low and high-speed needle valves 26, 28 is achieved by replacement of the pilot hole 98 with another angled bore 91. The bores 91 are preferably angled toward or away from one another and are preferably not parallel to one another. The opposing angles will help avoid misalignment of the block retainer 88 to the carburetor body 24 during assembly. Also during assembly, an indexing feature 100 of the block retainer 88 mates with a mating indexing feature 102 (shown in FIG. 16) on the carburetor body 24. Preferably, the indexing feature 100 is an inward extended pin and the mating indexing feature 102 of the carburetor body 24 is an orifice or receptacle.

When the block retainer 88 is utilized with the low and high-speed needle valves 26, 28 a threaded fastener 104 secures the block retainer 88 to the carburetor body 24. Preferably, the threaded fastener is a screw or bolt, counter sunk into the block retainer 88 and threaded into the carburetor body 24.

Figure 16:
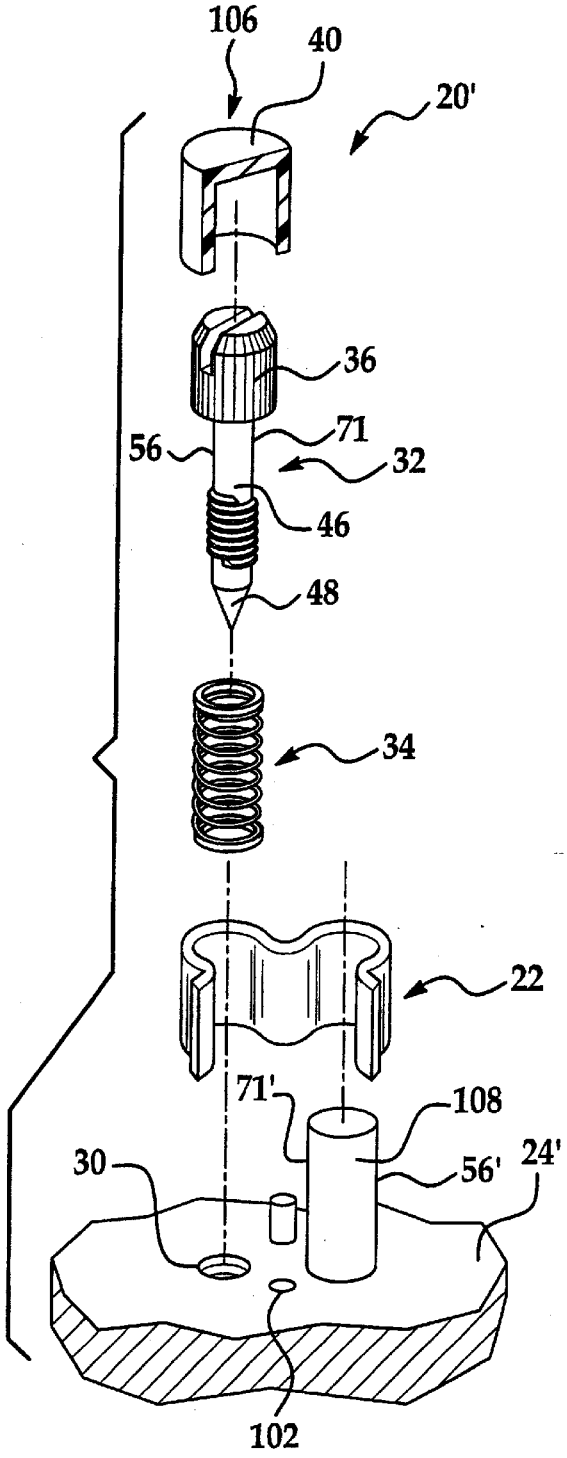
FIG. 16 is an exploded perspective view of a carburetor valve rotational setting retainer assembly illustrating a seventh embodiment having a single fuel needle valve and a pin.

Referring to FIG. 16, yet another embodiment of the retainer assembly 20' is shown wherein either the low or high-speed needle valve 26, 28 is a fuel needle valve 106 and the remaining valve is eliminated and replaced with a dummy needle valve or shaft 108 which projects rigidly outward from the carburetor body 24'. The retainer 22 engages the fuel-air mixture needle valve 106 and the shaft 108 as it does with the low and high-speed needle valves 26, 28 shown in FIG. 1. When utilizing the block retainer 88 embodiment of the retainer 22, the shaft 108 is press fitted into the pilot hole 98. This press fit eliminates the need for the threaded fastener 104. The preferable material for the block retainer 88 is plastic.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention.

We claim:

1. A retaining assembly to maintain yieldingly the rotational settings of a low and a high speed needle valve of a carburetor comprising:

a low speed needle valve having a rotatable elongated shank, a spring, and a head, the elongated shank engaged threadably to and projecting outward from the carburetor body, the spring disposed about the shank and axially compressibly between the carburetor body and the head, the head engaged with the shank, the head having an annular surface facing the carburetor body, the shank defined radially by a longitudinal outward surface and a longitudinal inward surface, the annular surface disposed radially outward from and perpendicular to the outward and inward surfaces;

a high speed needle valve having a rotatable elongated shank, a spring, and a head, the elongated shank engaged threadably to and projecting outward from the carburetor body, the spring disposed about the shank and axially compressibly between the carburetor body and the head, the head engaged with the shank, the head having an annular surface facing the carburetor body, the shank defined radially by a longitudinal outward surface and a longitudinal inward surface, the annular surface disposed radially outward from and perpendicular to the outward and inward surfaces, the shank of the low speed needle valve being parallel to the shank of the high-speed needle valve, the inward surface of the low-speed needle valve shank facing the inward surface of the high-speed needle valve shank;

a retainer engaged resiliently to the springs of the low and high-speed needle valves and thereby biasing laterally the low-speed needle valve shank and the high-speed needle valve shank; and two limiter caps engaged to the respective heads of the low and high-speed needle valves, wherein the limiter caps are engaged to the heads after the retainer is engaged to the springs of the low and high-speed needle valves.

2. The retaining device according to claim 1 wherein the retainer is a clip retainer having a first leg engaged laterally to the spring engaged laterally to the adjacent outward surface of the low-speed needle valve shank, a second leg engaged laterally to the spring engaged laterally to the outward surface of the high-speed needle valve shank, the first leg engaged unitarily to the second leg, the clip retainer interference fitted laterally about the respective springs of the low and high-speed needle valve shanks, wherein the low-speed needle valve projecting shank is biased laterally toward the high-speed needle valve projecting shank by the retainer.

3. The rotational retaining device according to claim 2 wherein the first and second legs of the clip retainer each have a distal end curving radially outward from the respective low and high-speed needle valve shanks.

4. The retaining device according to claim 1 wherein the retainer is a band retainer encircling both the springs of the low and high-speed needle valve shanks, the band retainer resiliently laterally engaging the springs which laterally engage the outward surfaces of the low and high-speed needle valve shanks, wherein the low-speed needle valve projecting shank is biased laterally toward the high-speed needle valve projecting shank by the band retainer.

5. The retaining device according to claim 4 wherein the band retainer is stretched prior to installing axially about the springs of the low and high-speed needle valve shanks.

6. The retaining device according to claim 4 wherein the band retainer is made of a polymeric material and shrunk by the application of heat after the band retainer is placed about the springs of the low and high-speed needle valve shanks.

7. The retaining device according to claim 1 wherein the retainer is a wedge retainer having a primary member having an enlarged distal end and an enlarged base end, the primary member extended between the distal and base ends, the primary member engaged laterally to the springs engaged laterally to the inward surfaces of the low and high-speed needle valve shanks between the distal and base ends, wherein the expanded distal end is snap fitted laterally past the inward surfaces of the low and high-speed needle valve shanks, and the low-speed needle valve projecting shank is biased laterally away from the high speed needle valve projecting shank by the wedge retainer.

8. The retaining device according to claim 7 wherein the wedge retainer has a first member engaged to the base end and extended perpendicularly from the primary member, the first member disposed tangentially to the spring of the low-speed needle valve.

9. The retaining device according to claim 8 wherein the wedge retainer has a second member engaged to the base end and extended perpendicularly from the primary member, the first member disposed tangentially to the spring of the high-speed needle valve.

10. The retaining device according to claim 1 wherein the retainer is a ring retainer having a circumferential inward surface engaged to and encircling the spring of the low-speed needle valve and a circumferential outward surface engaged to the spring of the high-speed needle valve, wherein the low speed needle valve projecting shank is biased laterally away from the high-speed needle valve projecting shank by the ring retainer.

11. The retaining device according to claim 1 wherein the retainer is a ring retainer having a circumferential inward surface engaged to and encircling the spring of the high-speed needle valve and a circumferential outward surface engaged to the spring of the low-speed needle valve, wherein the high-speed needle valve projecting shank is biased laterally away from the low-speed needle valve projecting shank by the ring retainer.

12. A retaining assembly to maintain yieldingly the rotational settings of a low and a high speed needle valve of a carburetor comprising:

a low speed needle valve having a rotatable elongate shank and a head, the elongate shank engaged threadably to and projecting outward from a carburetor body, and the shank defined radially by a longitudinal outward surface and a longitudinal inward surface;

a high speed needle valve having a rotatable elongate shank and a head, the elongate shank engaged threadably to and projecting outward from the carburetor body, and the shank defined radially by a longitudinal outward surface and a longitudinal inward surface;

the shank of the low-speed needle valve being parallel to the shank of the high-speed needle valve, the inward surface of the low-speed needle valve shank facing the inward surface of the high-speed needle valve shank; and a retainer engaged resiliently with the low speed and high-speed needle valves outward of the carburetor body to bias laterally and skew both the low-speed needle valve shank against the carburetor body and the high-speed needle valve shank against the carburetor body.

13. The retainer assembly according to claim 12 which also comprises two limiter caps engaged to the respective heads of the low and high-speed needle valves, wherein the limiter caps are engaged to the heads after the retainer is engaged with the low and high-speed needle valves.

14. The retaining assembly according to claim 12 which also comprises a first spring received over the shank of the low-speed needle valve between its head and the carburetor, a second spring received over the shank of the high-speed needle valve between its head and the carburetor, and the retainer is engaged resiliently to the springs for biasing laterally the shanks of the needle valves.

15. The retaining assembly according to claim 12 wherein the retainer is a band retainer encircling both the low and high-speed needle valve shanks, the band retainer resiliently laterally biasing the outward surfaces of the low and high-speed needle valve shanks, wherein the low-speed needle valve projecting shank is biased laterally toward the high-speed needle valve projecting shank by the band retainer.

16. The retaining assembly according to claim 15 wherein the band retainer is stretched prior to installing it axially about the low and high-speed needle valve shanks.

17. The retaining assembly according to claim 12 wherein the retainer is a ring retainer having a circumferential inward surface encircling one of the needle valves and a portion of a circumferential outward surface engaged to the spring adjacent the other valve, wherein the projecting shanks of the needle valves are biased laterally away from each other by the ring retainer.

18. A retaining assembly to maintain yieldingly the rotational settings of a low and a high speed needle valve of a carburetor comprising:

a low speed needle valve having a rotatable elongate shank and a head, the elongate shank engaged threadably to and projecting outward from a carburetor body, and the shank defined radially by a longitudinal outward surface and a longitudinal inward surface;

a high speed needle valve having a rotatable elongate shank and a head, the elongate shank engaged threadably to and projecting outward from the carburetor body, and the shank defined radially by a longitudinal outward surface and a longitudinal inward surface;

the shank of the low-speed needle valve being parallel to the shank of the high-speed needle valve, the inward surface of the low-speed needle valve shank facing the inward surface of the high-speed needle valve shank;

a retainer engaged resiliently with the low speed and high-speed needle valves to bias laterally the low-speed needle valve shank and the high-speed needle valve shank; and the retainer is a clip having a first leg engaged laterally with the adjacent outward surface of the low-speed needle valve shank, a second leg engaged laterally with the outward surface of the high-speed needle valve shank, the first leg engaged unitarily to the second leg, the clip retainer being interference fitted laterally about the low and high-speed needle valve shanks, wherein the low-speed needle valve projecting shank is biased laterally toward the high-speed needle valve projecting shank by the retainer.

19. A retaining assembly to maintain yieldingly the rotational settings of a low and a high speed needle valve of a carburetor comprising:

a low speed needle valve having a rotatable elongate shank and a head, the elongate shank engaged threadably to and projecting outward from a carburetor body, and the shank defined radially by a longitudinal outward surface and a longitudinal inward surface;

a high speed needle valve having a rotatable elongate shank and a head, the elongate shank engaged threadably to and projecting outward from the carburetor body, and the shank defined radially by a longitudinal outward surface and a longitudinal inward surface;

the shank of the low-speed needle valve being parallel to the shank of the high-speed needle valve, the inward surface of the low-speed needle valve shank facing the inward surface of the high-speed needle valve shank;

a retainer engaged resiliently with the low speed and high-speed needle valves to bias laterally the low-speed needle valve shank and the high-speed needle valve shank; and the retainer is a wedge retainer having a primary member having an enlarged distal end and an enlarged base end, the primary member extending between the distal and base ends, the primary member laterally biasing the inward surfaces of the low and high-speed needle valve shanks between the distal and base ends, wherein the expanded distal end is snap fitted laterally past the inward surfaces of the low and high-speed needle valve shanks, and the low-speed needle valve projecting shank is biased laterally away from the high-speed needle valve projecting shank by the wedge retainer.

* * * * *